US005902359A

United States Patent [19]

Grosso et al.

[11] Patent Number: 5,902,359

[45] Date of Patent: May 11, 1999

[54] ON-LINE AND/OR BATCH PROCESS FOR PRODUCTION OF FUEL MIXTURES CONSISTING OF COAL/ASPHALTENES, FUEL OIL/HEAVY CRUDE OIL, SURFACTANT AND WATER (CCTA), AND THE OBTAINED PRODUCTS

[75] Inventors: Jorge Luis Vargas Grosso, Bucaramanga; Oscar J. Medina Suarez, Santa Fe de Bogota; Gonzalo Diaz Leal, Bucaramanga; Rigoberto Barrero, Floridablanca; Lilia Rodriguez, Bucaramanga, all of Colombia

[73] Assignee: Empresa Colombiana de Petroleos—Ecopetrol, Santa Fe de Bogota, Colombia

[21] Appl. No.: 08/842,654

[22] Filed: Apr. 15, 1997

[51] Int. Cl.[6] ..... C10L 1/32

[52] U.S. Cl. ..... 44/281; 44/282

[58] Field of Search ..... 44/281, 282

[56] References Cited

U.S. PATENT DOCUMENTS

| | | | |
|---|---|---|---|
| 3,093,573 | 6/1963 | Corbett | 208/39 |
| 3,941,552 | 3/1976 | Cottell | 431/2 |
| 4,074,978 | 2/1978 | Panzer | 44/281 |
| 4,326,855 | 4/1982 | Cottell | 44/281 |
| 4,401,437 | 8/1983 | Poetschke | 44/281 |
| 4,403,997 | 9/1983 | Poetschke | 44/281 |
| 4,479,805 | 10/1984 | Batra | 44/282 |
| 4,628,204 | 12/1986 | Maes | 250/343 |
| 4,826,089 | 5/1989 | Psaltopoulos | 241/45 |
| 4,842,616 | 6/1989 | Verhille | 44/281 |
| 4,908,154 | 3/1990 | Cook et al. | 252/314 |
| 5,096,461 | 3/1992 | Frankiewicz et al. | 44/281 |
| 5,216,048 | 6/1993 | Agarwal et al. | 524/60 |
| 5,256,297 | 10/1993 | Feimer et al. | 210/651 |
| 5,283,001 | 2/1994 | Gregoli et al. | 44/301 |

FOREIGN PATENT DOCUMENTS

| | | |
|---|---|---|
| 94015174 | 4/1997 | Colombia . |
| 2165858 | 4/1986 | United Kingdom . |

*Primary Examiner*—Margaret Medley
*Attorney, Agent, or Firm*—Beveridge, DeGrandi, Weilacher & Young, L.L.P.

[57] ABSTRACT

An on-line and/or batch process to obtain a liquid mixture consisting of coal/asphaltenes-fuel oil/heavy crude oil-surfactant-water, through dispersion of a coal-water mixture, using a mechanical element defined as a static mixer or a tank with shaking.

14 Claims, 3 Drawing Sheets

ON-LINE AND/OR BATCH PROCESS FOR PRODUCTION OF FUEL MIXTURES CONSISTING OF COAL/ASPHALTENES, FUEL OIL/HEAVY CRUDE OIL, SURFACTANT AND WATER (CCTA), AND THE OBTAINED PRODUCTS

BACKGROUND OF THE INVENTION

The obtention of a liquid mixture comprising coal/asphaltenes-fuel oil/heavy crude oil-surfactant-water, is attained through an on-line and/or batch process aided by a static mixer or a tank with shaking devices. This liquid mixture is prepared from an emulsion of fuel oil/water or heavy crude oil/water type O/W, using an anionic surfactant and a polymeric stabilizer. Furthermore, a coal/water mixture is prepared by using the same anionic surfactant. Both fluids are mixed either by adding the coal/water mixture through a progressive-cavities pump or a centrifugal pump provided with open impeller, either to the emulsion, in a tank system with shaking devices or into a pipeline within a continuous system provided with static mixers.

The coal/asphaltenes-fuel oil/heavy crude oil-surfactant-water mixture obtained by both processes has a pseudoplastic rheological behaviour for coal concentrations from 5% to 35%, its viscosity is lower than that of the samples used for its preparation, is stable for several weeks, has a calorific power from 11000 to 13000 BTU/lb, being higher than that of the coal/water mixtures and is suitable for pipeline transportation. The rheological behaviour of these liquid mixtures is originated in the bi-modal character of the particle-size distribution of their components. The finest particles, in this case emulsionated fuel oil particles, perform the lubrication function, being placed within the interstitial spaces between the particles with bigger diameters, that is, the coal particles.

U.S. Pat. No. 3,941,552, 1976 and U.S. Pat. No. 4,326,855, 1982, to Eric C. Cotell, and others, concern to combustion, profitability and stability, the formation of a triple mixture with coal-fuel oil-water with additives of certain composition (50%-40%-10%) obtained through high-energy ultrasonic shaking, 38–54 watts/cm$^2$ and 15000 to 20000 Hz, which, in the shaking moment, fractionates the coal particles up to gel-sizes; these small sizes and use of too heavy fuel oils, grant the triple mixture an excellent stability but admitting a high viscosity In this case, the coal particles attain formation of two types of bonds or links: coal to coal bonds through water bridges and coal to coal bonds through fuel oil and additives links, giving as overall result a net structure, very stable but simultaneously too viscous, as clearly exposed in U.S. Pat. Nos. 4,403,997, 1983, and 4,401,437, 1983, to Leonard E. Poetshke, where coal concentration is increased up to 70% and proportions of fuel oil and water are reduced to 10% and 20%, respectively, using the same ultrasound technique used for preparing the mixture.

In UK Patent No. 2 165 858 to Gererd Antonini, 1986, released or exhausting water, present in the triple mixture as emulsionated particles within a continuous phase of fuel oil (direct emulsion) is used to facilitate its transportation. When this direct emulsion is treated by cutting forces, water is released and migrates and stays in the mixture-pipe interface and generates a lubricating film between those two elements; this film means a lower energy requirement for transportation, as if the mixture had a lower viscosity.

The Antonini's mixture is composed by 15% water, 40% fuel oil and 45% coal, with a particle size allowing 80% passing through a 200 mesh (74 microns); however, the mixture exhibits high viscosity and causes certain troubles when passing through burners.

U.S. Pat. No. 4,842,616, 1989, to Marcel Verhille, describes use of inverse emulsions, with low viscosity mixtures, because of their high water proportion, among 45% to 50%, showing these mixtures a non-defined particulate system for disperse phases as base for viscosity and stability, as offered by the new technology. On the other hand, a mixture with 50% water, does not have a high calorific power, as shown by triple mixtures as described in the herein shown technology, which makes them suitable to be used as fuels exhibiting excellent characteristics.

For gaining stability, the prior art employs three different additives: a polymeric emulsifier based on polyoxyethylene HLB 17, very expensive, besides a colloid, xanthate gums and an electrolyte, all under vigorous shaking. On the contrary, the technolgy described in the present patent application, only uses low-cost additives, locally manufactured with ECOPETROL-ICP technology, with no gums nor electrolites, and does not require an extreme shaking rate, usually the range from 100 to 300 rpm being enough. For the new technology, the particle size, for both the coal and the emulsion reaches great importance.

SUMMARY OF THE INVENTION

The present invention refers to obtention of a non-conventional fuel, in an on-line and/or batch process, starting form powdered coal, water, fuel oil/crude oil and a surfactant. The process is based on the formation of fuel oil/water or crude oil/water emulsion, of type O/W 70/30 with anionic surfactant concentration from 1000 to 3000 ppm, preferably from 1500 to 2500 ppm, and stabilizer concentration from 100 to 300 ppm, preferably from 150 to 250 ppm, featuring excellent stability and a viscosity range from 80 to 100 cP, and an average particle size from 4 to 7 microns. Separately, another mixture is prepared, comprising coal/water 70/30, using the same anionic surfactant up to a concentration range from 0.4% to 1.8%, preferably from 0.6 ppm to 1.5 ppm, with powdered coal with an average particle size about 6 times the particle size within the emulsion, that is, 40 microns. The two mixtures are stored in separate tanks provided with shaking systems.

BRIEF DESCRIPTION OF THE DRAWINGS

The present invention will be further understood with reference to the accompanying drawings, wherein.

DESCRIPTION OF THE PREFERRED EMBODIMENTS

Batch Process

The two fluids prepared by the above described methods are mixed by adding the coal/water mixture, by means of a progressive-cavities pump or an open-impeller centrifugal pump, to the emulsion in a tank system with shaking device, at low revolutions (from 100 to 300 rpm, preferably from 150 to 250 rpm), based on two double-effect shakers, radial and axial, mounted on the same axis.

On-Line Process

The above prepared and stored emulsion is pumped, under flow control, through a pipeline into which the mixture coal/water is injected, using either a progressive-cavities pump or an open-impeller centrifugal pump; the mixture flow must be controlled according to the coal proportion to be achieved in the final triple mixture. The fluids pre-mixture is passed throughout a set of static mixers, specially designed, giving as result at the end of the process the combustible mixture of coal-fuel oil-surfactant-water.

The mixture of coal-fuel oil-surfactant-water herein described, employs an inverse emulsion, where water is the continuous phase and fuel oil/cude oil, in small microscopic drops, is the disperse phase; the viscosity of the emulsion, used as base for the triple mixture, is low and close to the viscosity of the continuous phase, that is, that of the water; once the coal enters the system, a bi-modal mixture is formed, having a particle size corresponding to an even lower viscosity; this means easier transportation and no-troubles when passing through burners. By preparing emulsion inversely, allows to use any fuel oil, even the heaviest or extraheavy, since once the fuel oil is emulsified, the viscosity becomes low.

The obtained mixture by both processes exhibits a rheologic thixotropic behaviour for coal concentration between 5% and 35%, its viscosity is lower than those for the mixtures used in its preparation, due to a bi-modal effect arising from the particle size distribution (coal-emulsion), which is observed only in bi-modal mixtures of solids. The stability of this mixture was measured by using a new technology based on the calorific power and the percentage of water in the precipitated phase, regarding that coal-fuel oil-surfactant-water liquid mixtures obtained in the described way, remain stable for several weeks and the few precipitates are easily redispersible by moderate shaking or fluid recirculation; the calorific power oscillates between 11000 and 13000 BTU/lb, being higher than those for the coal-water mixtures. The typical composition of the mixture is 30% water, from 5% to 65% fuel oil and from 5% to 35% coal.

The liquid coal-fuel oil-surfactant-water mixture, is low-cost, has good ignition power, relatively high calorific power and, as a complement, exhibits a very low viscosity value, which makes it suitable for pipeline transportation.

The present invention will be better explained by means of the following examples, wich will not be considered as limitative of its scope:

EXAMPLE 1

Figure 1A:
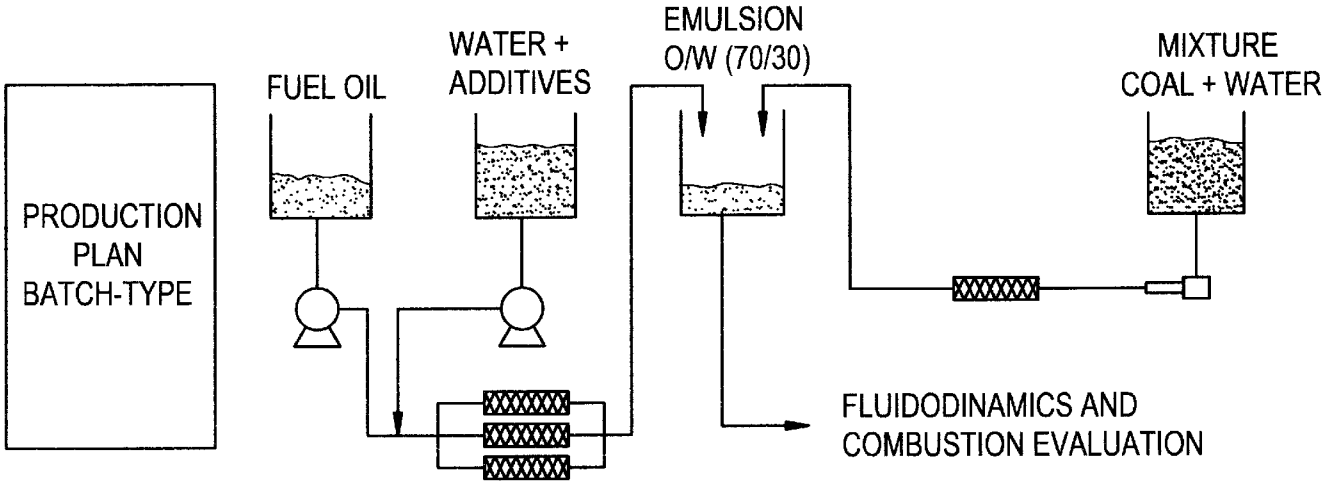
FIGS. 1A and 1B is a flow diagram relating to the formation of the mixture CCTA.
Figure 1B:
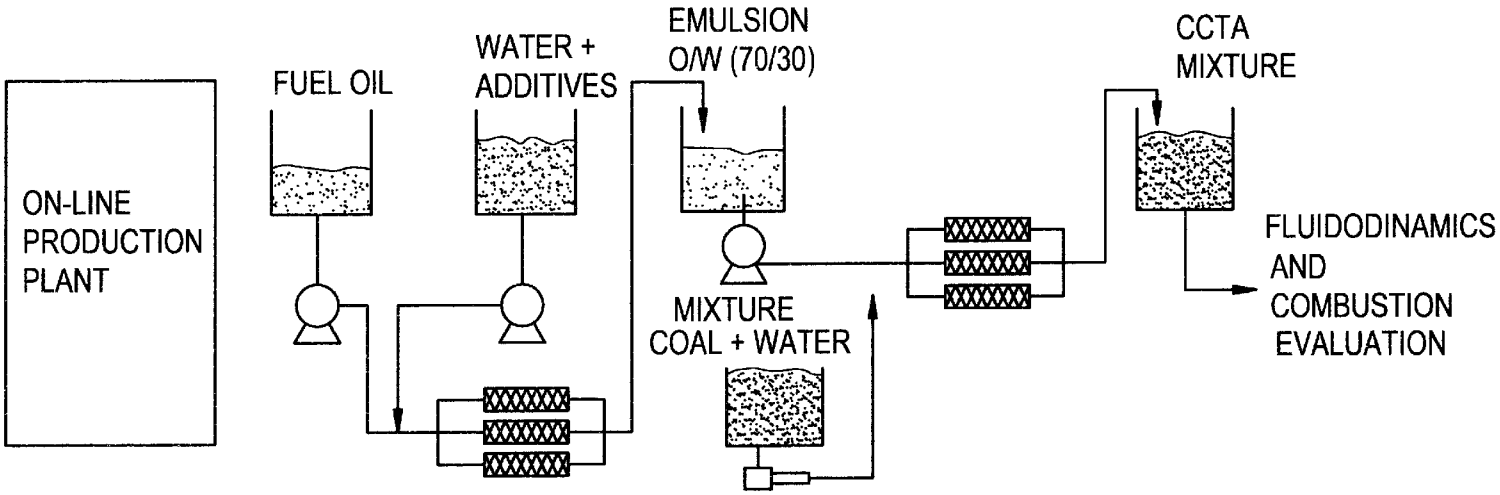

Two pre-mixtures are separately prepared, according to the procedure shown in FIG. 1:

An emulsion O/W 70/30 fuel oil-water, from fuel oils having viscosities from 800 to 12000 cP, with anionic surfactant within a concentration range from 1500 to 3000 ppm and polymeric stabilizer from 100 to 150 ppm.

A coal-water mixture 70/30, having viscosity about 4000 cP using the same anionic surfactant up to complete concentration from 11000 to 18000 ppm, depending on the coal concentration in the final mixture.

Once prepared, the coal-water mixture is added on the emulsion giving place to a triple mixture coal-fuel oil-surfactant-water, comprising about 30% water, from 5% to 35% coal and the balance in fuel oil; its viscosity is very low, from 75 cP to 180 cP, depending on the coal concentration, it is very stable and its precipitate is easily redispersible.

The advantage of this procedure, as described in the present invention, relies on the fact that it allows to obtain liquid mixtures with very low viscosity, suitable to be transported through pipelines. If, on the contrary, the process suffers any variation like, for example, addition of fuel oil with viscosities ranging between 800 cP and 12000 cP, to a coal-water mixture, with ethoxylated polymeric, either non-ionic or anionic surfactants, a coal-fuel oil-water-surfactant mixture is finally obtained having good stability but a very high viscosity range, from about 50000 cP to about 60000 cP.

EXAMPLE 2

The batch procedure shown in FIG. 1 to prepare coal/asphaltenes-fuel oil/heavy crude oil-surfactant-water liquid mixtures is followed. A water/coal mixture, similar to that mentioned in example 1, is added to the inverse emulsion similar to that of example 1, using for its preparation a dynamic mixer formed by two impellers whose design provides axial and radial flows, being mounted on the same axis and separated a certain distance equivalent to about one to about three times the diameter of the impeller. The appropriate shaking rates range between 150 and 300 rpm.

With this system as described in the present invention it is possible to prepare liquid mixtures with coal concentrations higher than 30%, with excellent stability against sedimentation and low viscosities. This system is the best alternative for preparing liquid mixtures, since if only one of the impellers is used to generate axial as well as radial flow, higher shaking rates are required (500 rpm) and the obtained mixtures admit only coal concentrations ranging from 5% to 20%. On the other hand, if a propeller-type impeller is used, a more vigorous shaking system is required (more than 800 rpm) and the maximum reachable coal concentration will range from 10% to 17.5%, with poor stability and low viscosities. From the energetic point of view, the shaking system of the present invention requires only 2% of the necessary energy required for a mixer provided with a propeller-type impelling system.

EXAMPLE 3

Once either the heavy-crude or fuel oil inverse emulsion O/W (70/30) and the coal-water mixture are prepared and stored, as explained in example 1, the emulsion is circulated, under flow control, using either a positive displacement pump or a centrifugal pump, by injecting, under flow control, the coal-water mixture by employing either a progressive-cavities pump or an open-impeller centrifugal pump. The pre-mixture, formed by injecting one fluid into the other, is passed throughout a set of static mixers, which provide the required cutting effort to form, at the end of the process, a liquid mixture comprising 30% water, from 35% to 65% fuel oil or heavy crude and from 5% to 35% coal, depending on the flows ratio between the emulsion mixture and the coal-water mixture. With this system as described in the present invention, the energy consumption in shaking is decreased down to the range from 14% to 60% of the energy required for the system as described in example 2.

The coal-fuel oil-surfactant-water mixture as obtained in this process has certain characteristics similar to those given in example 1.

EXAMPLE 4

Figure 3:
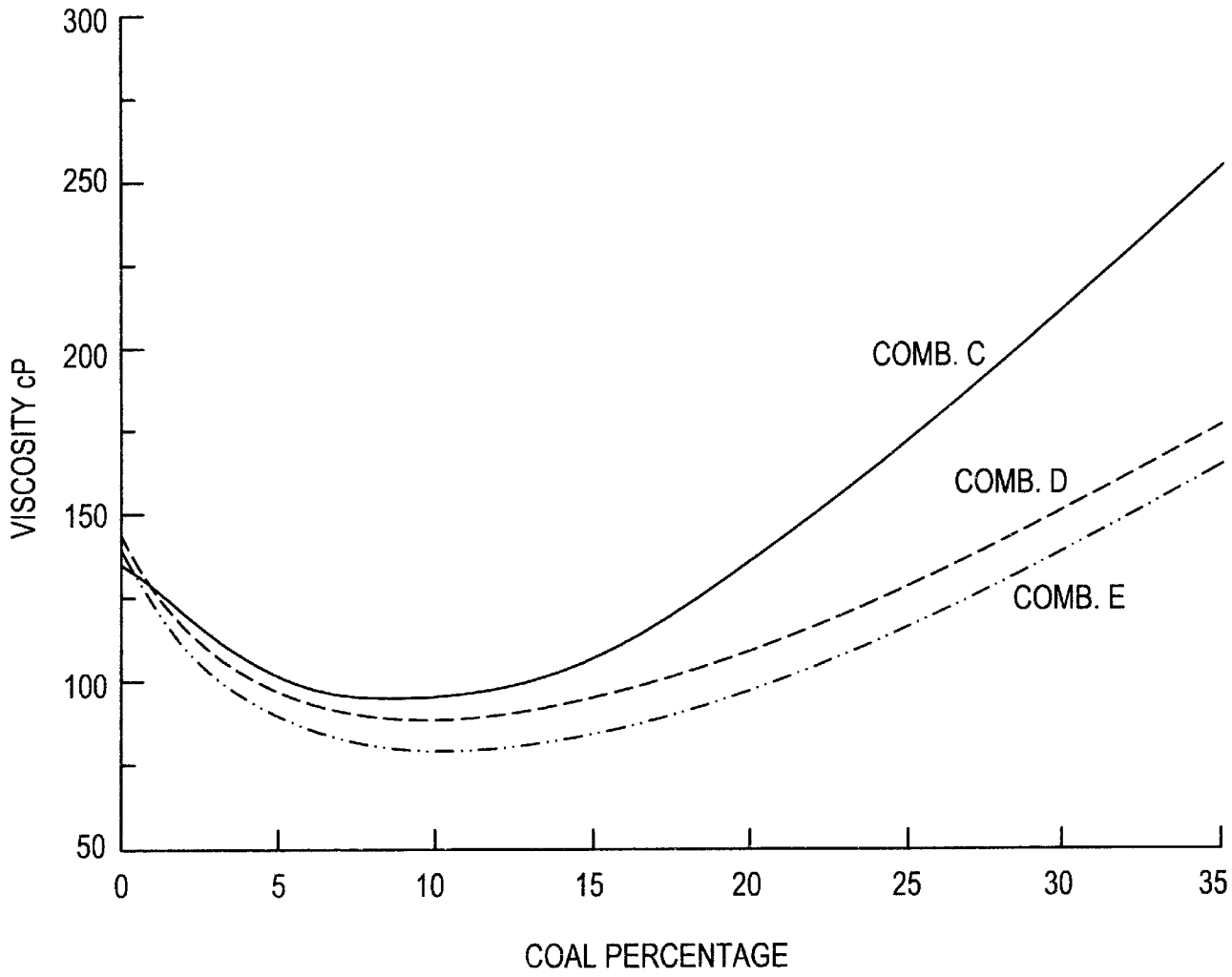
FIG. 3 is a plot of the variation of the viscosity versus cold percentage.

An emulsion O/W fuel oil-water 70/30 is prepared (including 1500 ppm to 3000 ppm of anionic surfactant and 100 ppm to 150 ppm of stabilizer, viscosity ranging from 135 cP to 140 cP), having a particle size ditribution between 6 and 7 microns. Separately, a coal-water 70/30 mixture is prepared (adding enough additive to get from 11000 ppm to 18000 ppm in the final coal-fuel oil-surfactant-water mixture), having 4000 cP in viscosity and an average particle size ranging from 40 to 45 microns, that is, about 6 times the particle size of the emulsion. Following either the batch or the on-line procedures described in the present invention, different proportions of coal-water mixture are added to the fuel oil-water emulsion, obtaining various coal-fuel oil-surfactant-water liquid mixtures, comprising from 5% to 35% coal, about 30% water and the balance in fuel oil, exhibiting viscosity values from 75 cP to 180 cP, with a minimum level of viscosity for coal contents from 10% to 15% (see FIG. 3), with pseudoplastic characteristics and calorific power from 11400 to 12500 BTU/lb. Due to the mentioned characteristics, this liquid mixture is suitable to be pumped through a pipeline.

EXAMPLE 5

An O/W fuel oil/heavy crude-water 70/30 emulsion is prepared and set to a temperature range from 40° to 50° C., including 3000 ppm of surfactant and 150 pp of stabilizer, using either fuel oil or crudes with high viscosity, from 5000 cP to 12000 cP. The resulting emulsion exhibits viscosity from 175 cP to 190 cP and particle size from 5 to 7 microns. A 70/30 coal-water, with particle size ranging from 40 mm to 45 mm, that is, 6 times the particle size of the emulsion (including the necessary amount of additive to give the final coal-fuel oil-surfactant-water a surfactant content from 11000 to 18000 ppm, viscosity 4000 cP), is added to the previous emulsion. Using any of the methods described in the present invention, a low viscosity coal-fuel oil-surfactant-water mixture is obtained, with pseudoplastic features and, as mixtures prepared from lighter fuel oils, these mixtures show a minimum viscosity between 10% and 15%.

EXAMPLE 6

Figure 2:
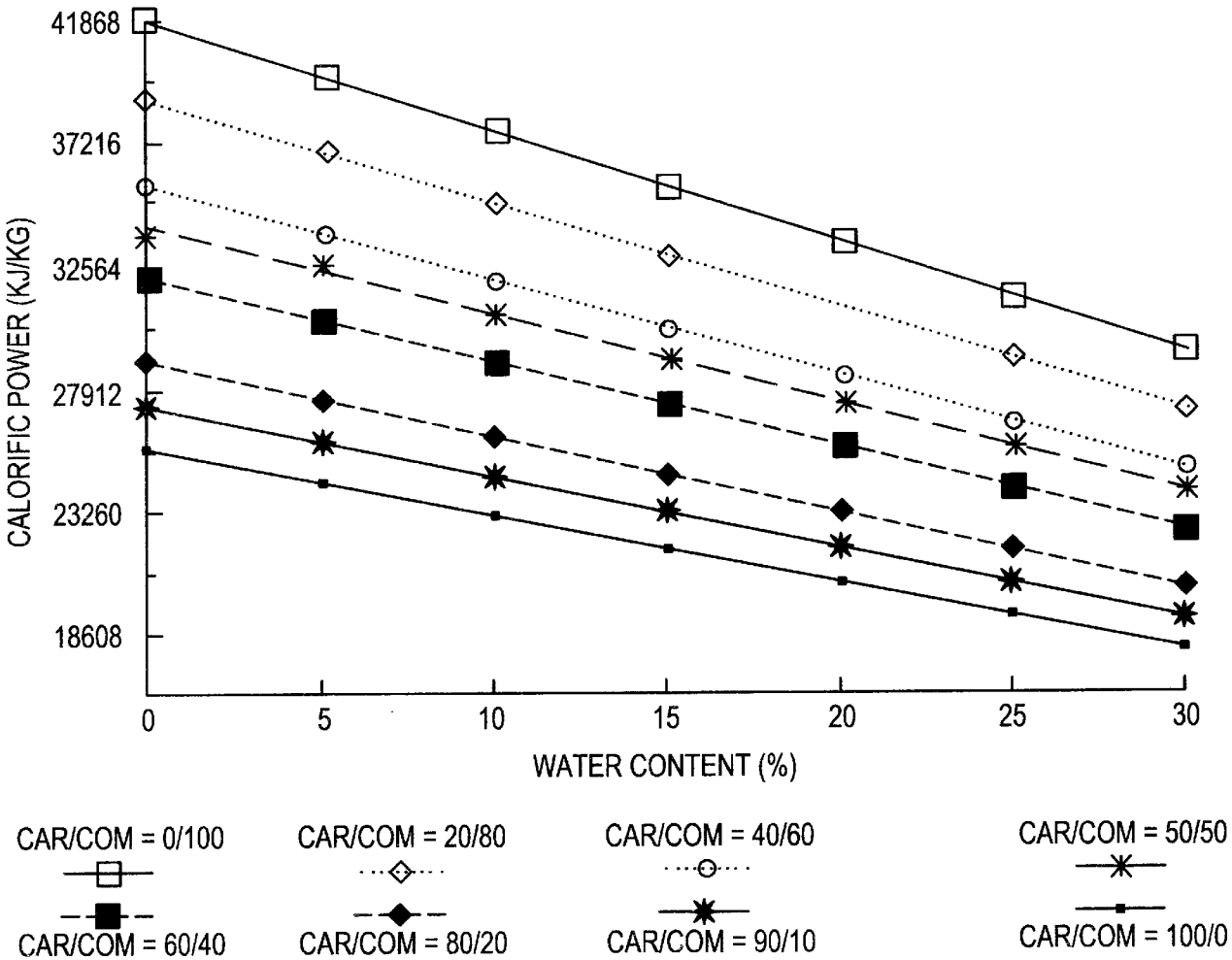
FIG. 2 is a plot of variation in calorific power in CCTA mixture for stability methodology.

The new technology used to measure stability of combustible systems with solids in suspension, as described in this example, requires measuring the calorific power of combustible components (in this case, coal and fuel oil/heavy crude). These data, graphically shown as Calorific Power vs. Water %, according to a numerical program, allow to find mixture composition for the coal-fuel oil-surfactant-water mixture (see FIG. 2).

By determining the calorific power for any of the phases formed within the coal-water or coal-fuel oil mixtures, together with measurement of water percentage in any of the phases or at any point along the sedimentation column, it is possible to precisely evaluate the variation of composition in the mixture, in relation to time, obtaining results with maximum errors of 2%, using samples from 1 to 5 grams and spending a short determination time.

EXAMPLE 7

The coal-fuel oil-surfactant-water mixture prepared by the procedure described in examples 1 or 3, by being pumped at fixed flows and constant temperature throughout either a progressive cavities pump or an open-impeller centrifugal pump, throughout a pipeline circuit, ½" and 1" internal diameter, provided with pressure and temperature readings transmiters, experiments minor or slightly major pressure decreases, compared to those of the original emulsion, depending on the coal concentration, having in mind that, in all cases, a high volumetric flow of mixture can be transported under a laminar-flow regime.

EXAMPLE 8

The mixture prepared as in examples 1 or 3, can be easily burned with no pre-heating, as follows:

The mixture stored at room conditions, is extracted by a progressive cavities pump and, under flow control, is atomized in a combustion chamber, using air or steam as atomizing agent, in ratios between 0.05 and 0.2, and a burner provided with a nozzle as used in fuel oil combustion. The mixture ignition is satisfactory, the flame is stable and $SO_X$ emissions are lower than produced by either the fuel oil emulsion or the crude oil emulsion used for its preparation.

We claim:

1. A process for the formation of a fluid fuel mixture of powdered coal or powdered asphaltenes, fuel oil, an anionic ethoxylated surfactant, a polymeric stabilizer and water, having easy handling properties, excellent stability, low viscosity, comprising the following steps:

(a) forming an aqueous slurry of wet or dry powdered coal or powdered asphaltenes and water, where said powdered coal or said powdered asphaltenes have an average particle size of from 40 to 45 microns, with a solids/water ratio of 70/30, and a concentration of anionic ethoxylated surfactant from 5,000 to 10,000 ppm, producing a mixture with viscosity values ranging from 3,000 to 5,000 cP, (b) forming on-line a fuel oil or crude oil and water inverse emulsion O/W (70/30), with the oil droplets having an average particle size from 4 to 7 microns and final viscosity values from 80 to 140 cP, by adding either atomized or diffused fuel oil in a water-anionic ethoxylated surfactant continuous phase, using a static mixer, said anionic surfactant is in a concentration range of from 1,000 to 3,000 ppm and is the same as in step (a), and a polymeric stabilizer in a concentration of 100 to 300 ppm, preparing a final product by adding and mixing the slurry in step (a) to the inverse emulsion of step (b), either in a tank at low revolutions of from 100 to 300 rpm, using mixers providing both axial and radial flow, or mixing on-line under flow control, by using either a progressive-cavities pump or open-impeller centrifugal pump, and static mixers.

2. The process as according to claim 1 wherein the concentration of the anionic surfactant in step (a) is 7,000 to 9,000 ppm.

3. The process according to claim 1 wherein the concentration of anionic surfactant in step (b) is 1500 to 2500 ppm.

4. The process according to claim 1 wherein the shakers are the propeller shaker providing shaking rates higher than 800 rpm.

5. The process according to claim 1 where the static mixer is a set of either three or four.

6. The process according to claim 1 where the crude oil is used.

7. The process according to claim 2 where the shakers are the propeller shakers providing shaking rates higher than 800 rpm.

8. The process according to claim 3 where the shakers are the propeller shakers providing shaking rates higher than 800 rpm.

9. The process according to claim 2 where the static mixer is a set of either three of four.

10. The process according to claim 3 where the static mixer is a set of either three of four.

11. The process according to claim 6 where the static mixer is a set of either three of four.

12. A combustible emulsified fuel mixture comprising coal or powdered asphaltene, fuel oil, an anionic ethoxylated surfactant, a polymeric stabilizer and water, suitable to be transported through pipelines which is dynamically and statically stable, prepared by the process of claim 1 and where its final viscosity is in the range of from about 80 cP to about 300 cP, its average particle diameter ranges from about 4 to about 40 microns, containing from about 0.5% to about 1.8% surfactant, about 30% water, from about 5% to about 35% powdered coal or powdered asphaltenes, and the balance is constituted by fuel oil or crude oil, exhibiting calorific power from about 10,000 BTU/lb to about 13,000 BTU/lb, having pseudoplastic and thixotropic characteristics.

13. The fuel mixture according to claim 12 wherein powdered asphaltenes and crude oil are present.

14. The fuel mixture according to claim 12 which contains from about 0.6% to about 1.5% surfactant.

* * * * *

UNITED STATES PATENT AND TRADEMARK OFFICE

CERTIFICATE OF CORRECTION

PATENT NO. : 5,902,359

DATED : May 11, 1999

INVENTOR(S) : GROSSO, et al.

It is certified that error appears in the above-identified patent and that said Letters Patent is hereby corrected as shown below:

ON THE COVER PAGE OF THE PATENT:

Under section [19] Title, change "Grosso et al." to --Vargas et al.--;

Under section [75] Inventors, change "Jorge Luis Vargas Grosso" to --Jorge Luis Grosso Vargas--;

Under section [75] Inventors, change "Oscar J. Medina Suarez" to --Oscar J. Suarez Medina--; and Under section [75] Inventors, change "Gonzalo Diaz Leal" to --Gonzalo Leal Diaz--.

Signed and Sealed this

Thirteenth Day of June, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 5,902,359
DATED : May 11, 1999
INVENTOR(S) : Jorge Luis Vargas Grosso et al.

It is certified that error appears in the above-identified patent and that said Letters Patent is hereby corrected as shown below:

ON THE TITLE PAGE OF THE PATENT:

On the title page, in the listing of "[19] Title", under the heading "United States Patent", please change "Vargas et al. al." to --Grosso et al.--.

Signed and Sealed this

Twenty-fourth Day of October, 2000

*Attest:*

Q. TODD DICKINSON

*Attesting Officer*

*Director of Patents and Trademarks*